US008505118B2

(12) United States Patent
Bang

(10) Patent No.: US 8,505,118 B2
(45) Date of Patent: Aug. 13, 2013

(54) EXPANDABLE POCKET

(75) Inventor: MunHui Diane Bang, Oakland, CA (US)

(73) Assignee: 511, Inc., Modesto, CA (US)

( * ) Notice: Subject to any disclaimer, the term of this patent is extended or adjusted under 35 U.S.C. 154(b) by 407 days.

(21) Appl. No.: 12/570,176

(22) Filed: Sep. 30, 2009

(65) Prior Publication Data

US 2011/0072556 A1 Mar. 31, 2011

(51) Int. Cl.
*A41D 1/06* (2006.01)
*A41D 27/20* (2006.01)

(52) U.S. Cl.
USPC ..... 2/227; 2/247; 2/252

(58) Field of Classification Search
USPC ..... 2/247, 227, 228, 244, 245, 86, 248, 2/249, 250, 251, 252, 254, 102, 81
See application file for complete search history.

(56) References Cited

U.S. PATENT DOCUMENTS

| | | | | | |
|---|---|---|---|---|---|
| 145,178 | A | | 12/1873 | Hopkins | |
| 1,112,805 | A | * | 10/1914 | Kaufman | 2/113 |
| 1,224,842 | A | * | 5/1917 | Boyd | 2/252 |
| 1,982,100 | A | * | 11/1934 | Heile | 2/253 |
| 1,995,143 | A | | 3/1935 | Burch | |
| 2,211,550 | A | | 8/1940 | Tworoger | |
| 2,663,876 | A | * | 12/1953 | Miller et al. | 2/227 |
| 3,217,335 | A | * | 11/1965 | Bell | 2/93 |
| 3,435,462 | A | * | 4/1969 | Bank | 2/227 |
| 4,123,804 | A | * | 11/1978 | Michael et al. | 2/247 |
| 4,451,935 | A | | 6/1984 | Henschel | |
| 4,490,858 | A | | 1/1985 | Batavier | |
| 4,513,455 | A | | 4/1985 | Gerhardt | |
| 4,637,075 | A | * | 1/1987 | Ingrisano et al. | 2/94 |
| 4,716,600 | A | | 1/1988 | van Beek | |
| 4,731,883 | A | | 3/1988 | Foster | |
| 4,817,210 | A | * | 4/1989 | Aldridge et al. | 2/81 |
| 5,072,456 | A | | 12/1991 | Elin | |
| 5,265,782 | A | * | 11/1993 | McNamara | 2/94 |
| 5,365,614 | A | | 11/1994 | Perkins | |
| 5,465,425 | A | * | 11/1995 | Crispin | 2/102 |
| 5,477,562 | A | * | 12/1995 | Dixon | 2/250 |
| 5,495,620 | A | | 3/1996 | Schoenweiss et al. | |
| 5,509,147 | A | | 4/1996 | Busquets | |
| 5,588,154 | A | | 12/1996 | Blauer et al. | |
| 5,664,256 | A | * | 9/1997 | Blauer et al. | 2/69 |
| 5,669,078 | A | * | 9/1997 | Scremin et al. | 2/247 |
| 5,720,050 | A | | 2/1998 | Gioli | |
| 5,832,536 | A | * | 11/1998 | Kramer | 2/69 |
| 5,870,777 | A | * | 2/1999 | Hans | 2/238 |
| 5,884,332 | A | * | 3/1999 | Snedeker | 2/97 |
| 5,901,372 | A | * | 5/1999 | Lawler | 2/69 |
| 6,216,280 | B1 | * | 4/2001 | Rabe | 2/247 |
| 6,240,564 | B1 | * | 6/2001 | Te Kanawa | 2/115 |
| 6,328,191 | B1 | * | 12/2001 | Conley et al. | 224/563 |
| 6,687,919 | B2 | | 2/2004 | Dilworth, Jr. et al. | |
| D534,708 | S | * | 1/2007 | Helbing et al. | D2/742 |
| D536,159 | S | * | 2/2007 | Helbing et al. | D2/851 |

(Continued)

*Primary Examiner* — Alissa L Hoey
(74) *Attorney, Agent, or Firm* — Wolfe-SBMC

(57) ABSTRACT

An expandable pocket is described. In one or more implementations, a pocket is comprised of a front panel attached to a back panel. The front panel is configured to expand. Additionally, the front panel is configured to substantially maintain alignment of a portion of a stripe disposed on the front panel with a portion of the stripe disposed on the back panel. The front panel is configured to maintain this alignment when the front panel is expanded and when the front panel is not expanded.

9 Claims, 11 Drawing Sheets

(56) References Cited

U.S. PATENT DOCUMENTS

| | | | | |
|---|---|---|---|---|
| D543,009 | S * | 5/2007 | Helbing et al. | D2/742 |
| D543,012 | S * | 5/2007 | Helbing et al. | D2/851 |
| 7,231,672 | B2 * | 6/2007 | Thomas | 2/400 |
| D545,529 | S * | 7/2007 | Helbing et al. | D2/731 |
| 7,278,171 | B1 * | 10/2007 | Besch | 2/48 |
| 7,296,303 | B1 * | 11/2007 | Samet | 2/115 |
| D581,631 | S * | 12/2008 | Hennings | D2/731 |
| D603,138 | S * | 11/2009 | Hennings et al. | D2/738 |
| 7,707,658 | B2 * | 5/2010 | Culhane | 2/227 |
| 7,784,109 | B2 * | 8/2010 | Seguin et al. | 2/93 |
| 7,793,359 | B2 * | 9/2010 | Spiewak et al. | 2/69 |
| 7,908,675 | B2 * | 3/2011 | Robinson | 2/247 |
| 2007/0067889 | A1 * | 3/2007 | Spiewak et al. | 2/69 |
| 2008/0047046 | A1 * | 2/2008 | Maier | 2/102 |
| 2008/0067202 | A1 * | 3/2008 | Silva et al. | 224/148.2 |
| 2008/0163404 | A1 * | 7/2008 | Carpentier et al. | 2/81 |
| 2008/0256689 | A1 * | 10/2008 | Grilliot et al. | 2/455 |
| 2009/0126073 | A1 * | 5/2009 | Lovett | 2/115 |
| 2010/0192276 | A1 * | 8/2010 | Anderson | 2/115 |
| 2011/0061146 | A1 * | 3/2011 | Spiewak et al. | 2/227 |

* cited by examiner

EXPANDABLE POCKET

BACKGROUND

Pockets may be used to provide a variety of functionality, such as to compartmentalize items, store items, and so on. In law enforcement, for example, pockets are typically part of a law enforcement officer's uniform or equipment, and allow the officer to stow such items in locations to improve accessibility of those items to the officer.

One type of pocket is commonly referred to as a "cargo pocket." Conventional cargo pockets are designed to allow the cargo pocket to expand to accommodate larger items than a similarly sized non-cargo pocket. However, stowing such items in a conventionally designed cargo pocket can cause the pocket to lose suitability for other purposes, such as inclusion as a part of a uniform. Therefore, traditional cargo pockets had limited placement options when included on a uniform.

SUMMARY

An expandable pocket is described. In one or more implementations, a pocket is comprised of a front panel attached to a back panel. The front panel is configured to expand. Additionally, the front panel is configured to substantially maintain alignment of a portion of a stripe disposed on the front panel with a portion of the stripe disposed on the back panel. The front panel is configured to maintain this alignment when the front panel is expanded and when the front panel is not expanded.

In one or more implementations, a pocket is comprised of a back panel, a pocket flap attached to the back panel, and a front panel attached to a back panel. The front panel has one or more creases that form one or more bellows. Further, the front panel is configured to expand and to substantially maintain a positioning and an alignment of a stripe. The positioning of the stripe is perpendicular to an opening of the front panel. The alignment of the stripe appears contiguous along a length of the stripe that extends from the front panel and across the back panel and the pocket flap.

In one or more implementations, a garment includes a back panel configured as at least a portion of a pair of pants and a front panel attached to the back panel to form a pocket. The front panel is configured to expand away from the back panel. Additionally, when the front panel is expanded, it is configured to substantially maintain an alignment of at least a portion of a stripe disposed on the front panel with a portion of the stripe that is disposed on the back panel.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed invention.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different instances in the description and the figures may indicate similar or identical items.

DETAILED DESCRIPTION

Overview

Stowing items in a conventionally-designed cargo pocket can significantly change the shape of the pocket. For example, conventional cargo pocket designs were created with multiple bellows that allowed the outside of the cargo pocket to expand to accommodate large and/or multiple items. However, this conventional design also allowed the pocket to protrude, bulge, and sag. Therefore, this expansion prevented conventional cargo pocket designs from being used in certain instances, such as on a uniform. For example, the uniform may include a stripe. Inclusion of the stripe on the conventional cargo pocket, however, would cause the stripe to become misaligned and thus hinder the look of the uniform. Thus, traditional cargo pockets were not used on parts of the uniform that included the stripe.

A pocket is described that is configured to expand yet maintain alignment with the rest of an article, such as a uniform. For example, the pocket may be located on a uniform (e.g. a pair of uniform pants) for a law enforcement officer in alignment with a vertically-positioned stripe. In an implementation, the pocket is configured to expand yet maintain a vertical positioning of a stripe on the pocket in relation to the stripe on the rest of the uniform.

Additionally, the stripe's positioning may be maintained even though the pocket may assume a variety of shapes, e.g., through various degrees of expansion. For example, a front panel of the pocket may be configured to maintain the stripe's alignment when small and even no items are inserted in the pocket. Thus, in this example the front panel lies substantially flat against a back panel of the pocket. Additionally, the front panel is configured to maintain the stripe's position as the pocket expands, e.g., such as by being "reached into" which may cause an opening of the pocket to expand. Further, the stripe's position may be maintained while items are being stowed in the pocket, such as when the opening of the pocket is closed against the back panel. Thus, the alignment of the stripe is maintained even as the pocket changes shape, which may increase the suitability of the pocket for inclusion as a part of a uniform or other article. A variety of other examples are also contemplated, further discussion of which may be found in relation to the following sections.

In the following discussion, a pocket is described by way of example in conjunction with a uniform or equipment for law enforcement that may include a vertically-positioned stripe. However, it should be readily apparent that the following discussion is not limited to a uniform, law enforcement, or a vertically-positioned stripe. Accordingly, a variety of different articles (e.g., garments and other equipment) may employ the techniques described herein without departing from the spirit and scope thereof, such as shirts, vests, jackets, footwear, backpacks, bags, upholstery (e.g., automobiles and furniture), and so on.

Example Pocket

Figure 1:
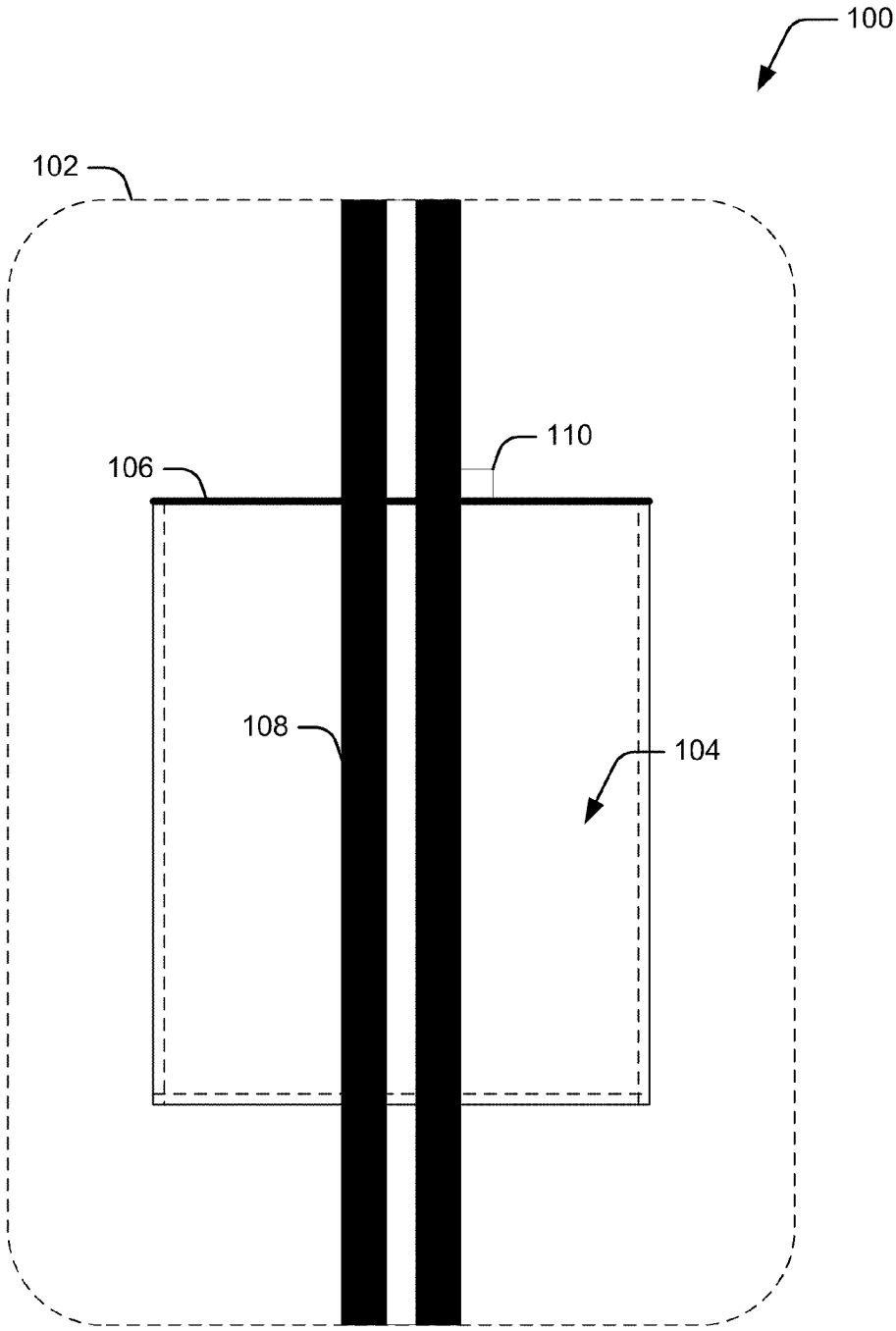
FIG. 1 is an illustration of a pocket in an example implementation configured for inclusion as a part of a uniform or other article.

FIG. 1 is an illustration of a pocket 100 in an example implementation that is configured for inclusion as a part of a uniform or other article. The illustrated pocket 100 includes a back panel 102 and a front panel 104 that is attached to the back panel 102. The back panel 102 may be a portion of a garment (e.g., a pair of pants), a portion of a piece of equipment (e.g., a backpack), or other area where it is desirable to locate a pocket. The front panel 104 is attached to the back panel 102 leaving an opening 106. As illustrated, the front panel 104 has a generally rectangular shape and is attached to the back panel 102 along the left, bottom, and right sides of the front panel 104 to form a pocket. Thus, in this example the top side of the front panel 104 is not sewn to the back panel and thus forms the opening 106 of the front panel 104.

In the illustrated example, the pocket 100 also includes a portion of a stripe 108 that is vertically-positioned along a first axis. The stripe is illustrated as being included on both the front panel 104 of the pocket 100 and aligned with a stripe on the back panel 102. One of the challenges attendant with aligning the stripe 108 across the panels, however, is to maintain visual continuity of the stripe 108 along the stripe's length.

As previously described, severing visual continuity of the stripe 108 can be undesirable, especially when the stripe 108 is utilized to visually distinguish law enforcement officers from other citizens as well as to promote respect through a harmonious and "clean" appearance. For example, assume that the pocket 100 is located on a pair of pants worn by an individual approximately where the individual's arms fall when standing upright. Also assume for the sake of discussion that the stripe 108 is vertically-positioned to run along the outer seams of those pants such that the stripe 108 "runs over" the cargo pockets. The conventional approach to cargo pocket construction could cause the cargo pocket to expand and sever the visual continuity of the stripes, an undesirable effect of expansion. However, the illustrated pocket 100 is configured such that the front panel 104 of the pocket 100 may expand to stow various items yet substantially maintain the contiguous alignment of the stripe 108 and may maintain the perpendicular positioning 110 of the stripe 108 in relation to the opening 106. Further, the pocket 100 is configured to maintain the visual continuity of the stripe 108 along the stripe's length even when the pocket changes shape, further discussion of which may be found in relation to the following figures.

Figure 2A:
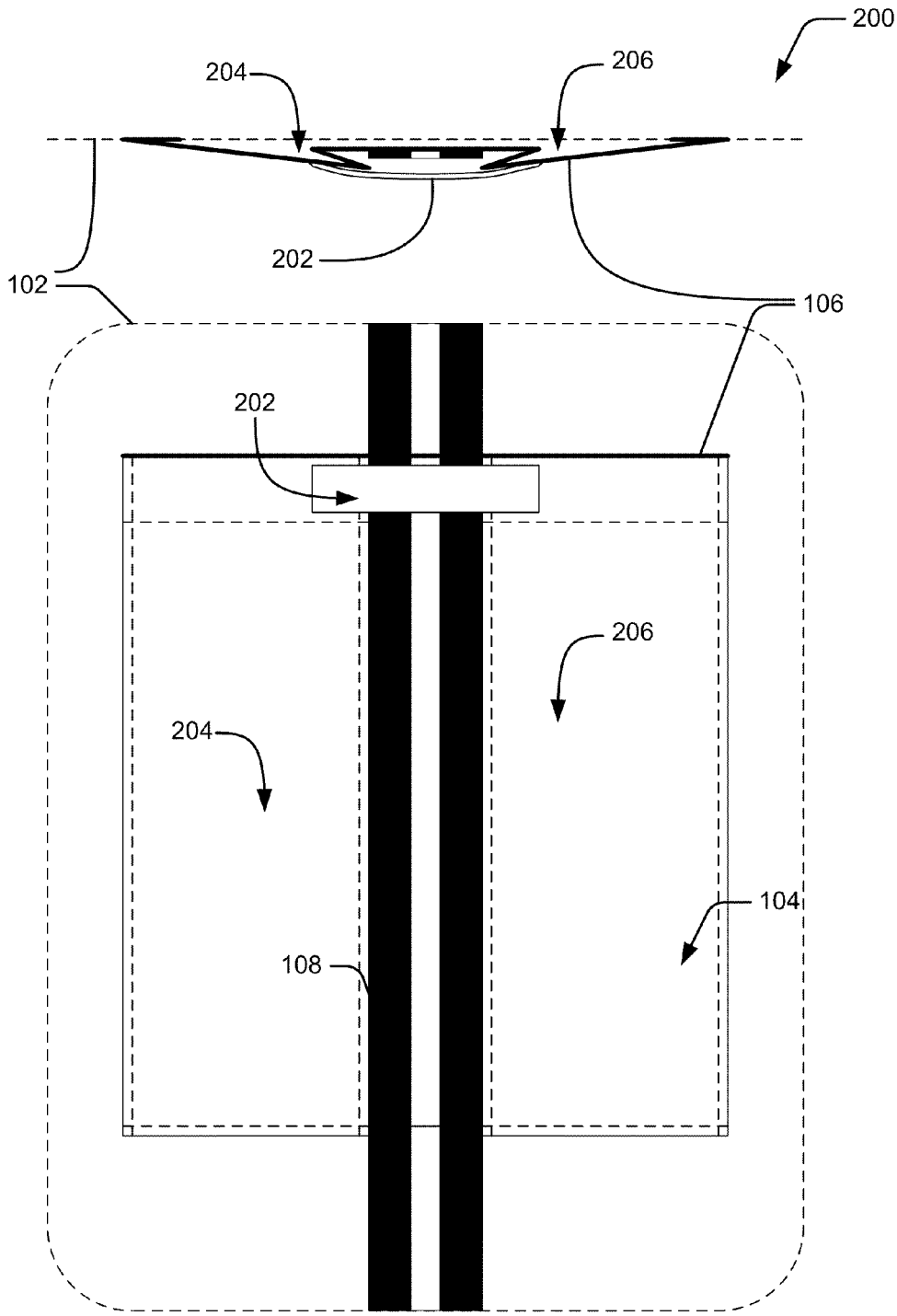
FIG. 2A is an illustration of a pocket in an example implementation showing a configuration where neither the front panel nor the opening of the front panel is expanded.

FIG. 2A is an illustration of a pocket 200 in an example implementation showing a configuration where neither the front panel 104 nor the opening 106 of the front panel 104 is expanded. Such a condition may occur when the pocket 200 is not being used to store items. In this illustration, the pocket 200 includes a band 202 that is expandable (e.g., may have elastic properties) and that is configured to close the opening 106 of the front panel 104 against the back panel 102. In other words, the band 202 biases the opening 106 to a closed state. This causes the front panel 104 to lie substantially flat and close the front panel 104 against the back panel 102.

As illustrated in FIG. 2A, the front panel 104 is creased and attached to the back panel 102 to form two bellows 204, 206 that slightly overlap a center section 208 that includes at least a portion of the stripe 108. In this example, the band 202 is located perpendicular to and within the two bellows 204, 206. The band 202 also exits the two bellows 204, 206 where the front panel 104 is creased and is exposed where it crosses over the center section 208 between the creases forming the two bellows 204, 206. When the pocket 200 is empty, as in FIG. 2A, the expandable band 202 is configured to hold the two bellows 204, 206 in a creased position against the back panel 102. This promotes the vertical alignment of the center section 208 in this example and thus maintains the alignment and visual continuity of the stripe 108.

Figure 2B:
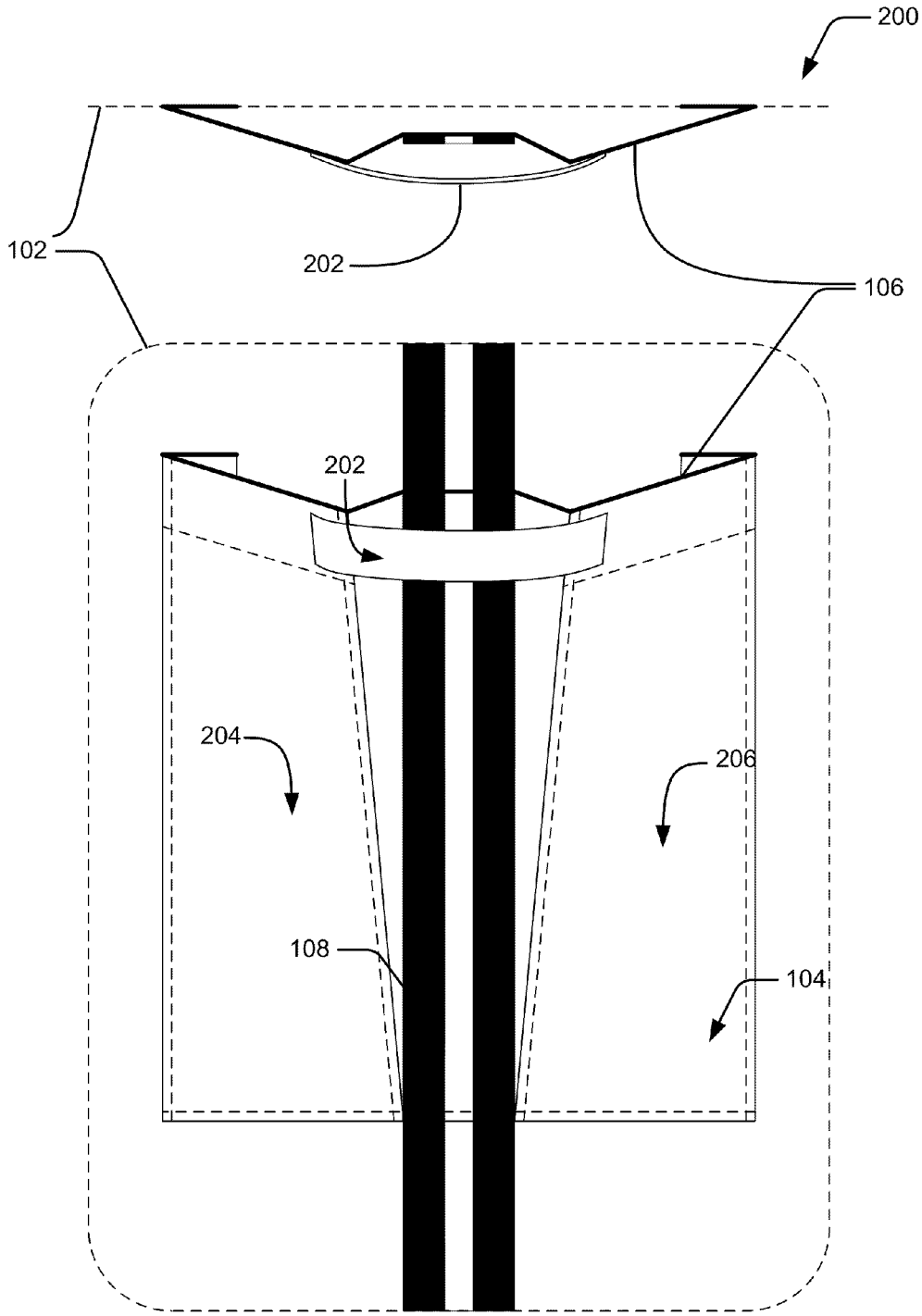
FIG. 2B is an illustration of the pocket in an example implementation showing a configuration in which the opening of the front panel has expanded.

FIG. 2B is an illustration of the pocket 200 in an example implementation showing a configuration in which the opening 106 of the front panel 104 has expanded. Such expansion may occur, for example, when the pocket 200 is being "reached into" by a hand or other object. As a result, the opening 106 of the front panel 104 is displaced away from the back panel 102 thus causing the front panel 104 to "bow out." In the illustrated example, the expandable band 202 is configured to expand outwardly using the two bellows 204, 206.

For example, the creases forming the two bellows 204, 206 are configured to unfold as the expandable band 202 is expanded outwardly thus expanding the opening 106. During this expansion, the front panel 104 is configured to substantially maintain both the alignment of the stripe 108 and the perpendicular positioning 110 of the stripe 108 relative to the opening 106.

Figure 2C:
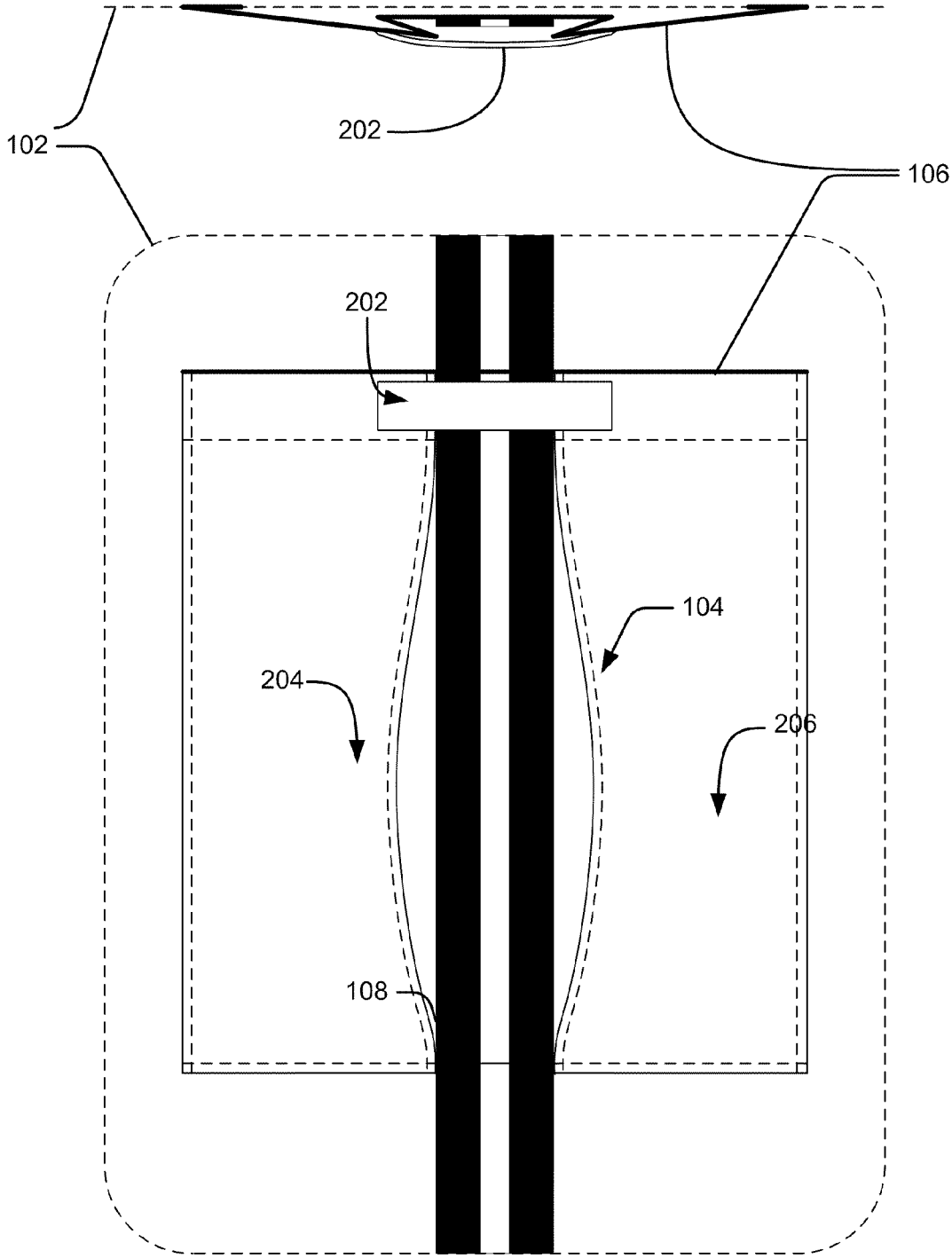
FIG. 2C is an illustration of the pocket in an example implementation in which the two bellows are expanded but the opening of the front panel is not expanded.

FIG. 2C is an illustration of the pocket 200 in an example implementation depicting a configuration where the two bellows 204, 206 are expanded but the opening 106 of the front panel 104 is not expanded. Such a configuration may occur, for example, when the pocket 200 is used to accommodate one or more items, but is not currently being "reached into." In this instance, the band 202 closes the opening 106 of the front panel 104 against the back panel 102 as in FIG. 2A.

Additionally, the creases of the front panel 104 that form the two bellows 204, 206 have unfolded to permit the pocket 200 to expand in this figure. Despite outward expansion of the two bellows 204, 206, the expandable band 202 substantially maintains the perpendicular positioning 110 and alignment of the stripe 108. Thus, as depicted in FIGS. 2A-2C, the pocket 200 is configured to expand yet maintain alignment of the center section 208 and thus the stripe 108. The pocket 200 may also include a variety of other functionality, further discussion of which may be found in relation to the following figure.

Figure 3:
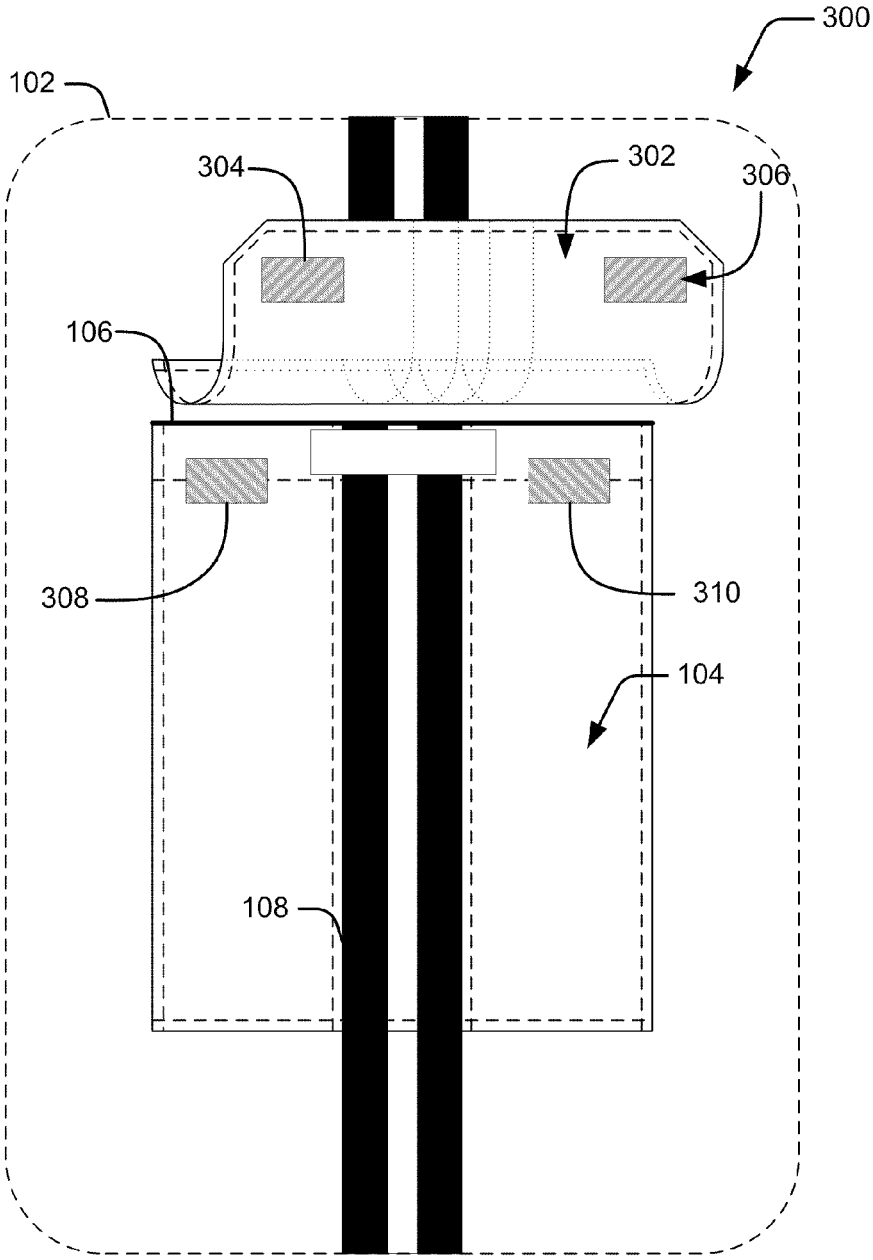
FIG. 3 is an illustration of a pocket in an example implementation that includes a pocket flap.

FIG. 3 is an illustration of a pocket 300 in an example implementation that includes a pocket flap 302. The illustrated pocket 300 includes the front panel 104 attached to the back panel 102, the band 202, and the two bellows 204, 206 as previously described in relation to FIGS. 2A-2C. The pocket flap 302 is configured to cover the opening 106 of the front panel when the pocket flap 302 is closed.

For example, the pocket flap 302 is illustrated as attached to the back panel 102 at a location above the opening 106 of the front panel 104. The pocket flap 302 and the front panel 104 include hook-and-loop closures 304, 306, 308, 310 which may be used to secure the pocket flap 302 to the front panel 104 and release the pocket flap 302 from the front panel 104. When the pocket flap 302 is secured, the opening 106 of the front panel 104 is covered by the pocket flap 302.

The pocket 300 also includes the stripe 108, as in FIG. 1. In this example, the stripe 108 is also shown as "running down" the pocket flap 302 such that the stripe 108 is aligned across the front panel 104 of the pocket 300 and the pocket flap 302. Thus, the pocket flap 302 mimics the perpendicular positioning 110 of the stripe 108 relative to the opening 106 of the front panel 104.

Figure 4:
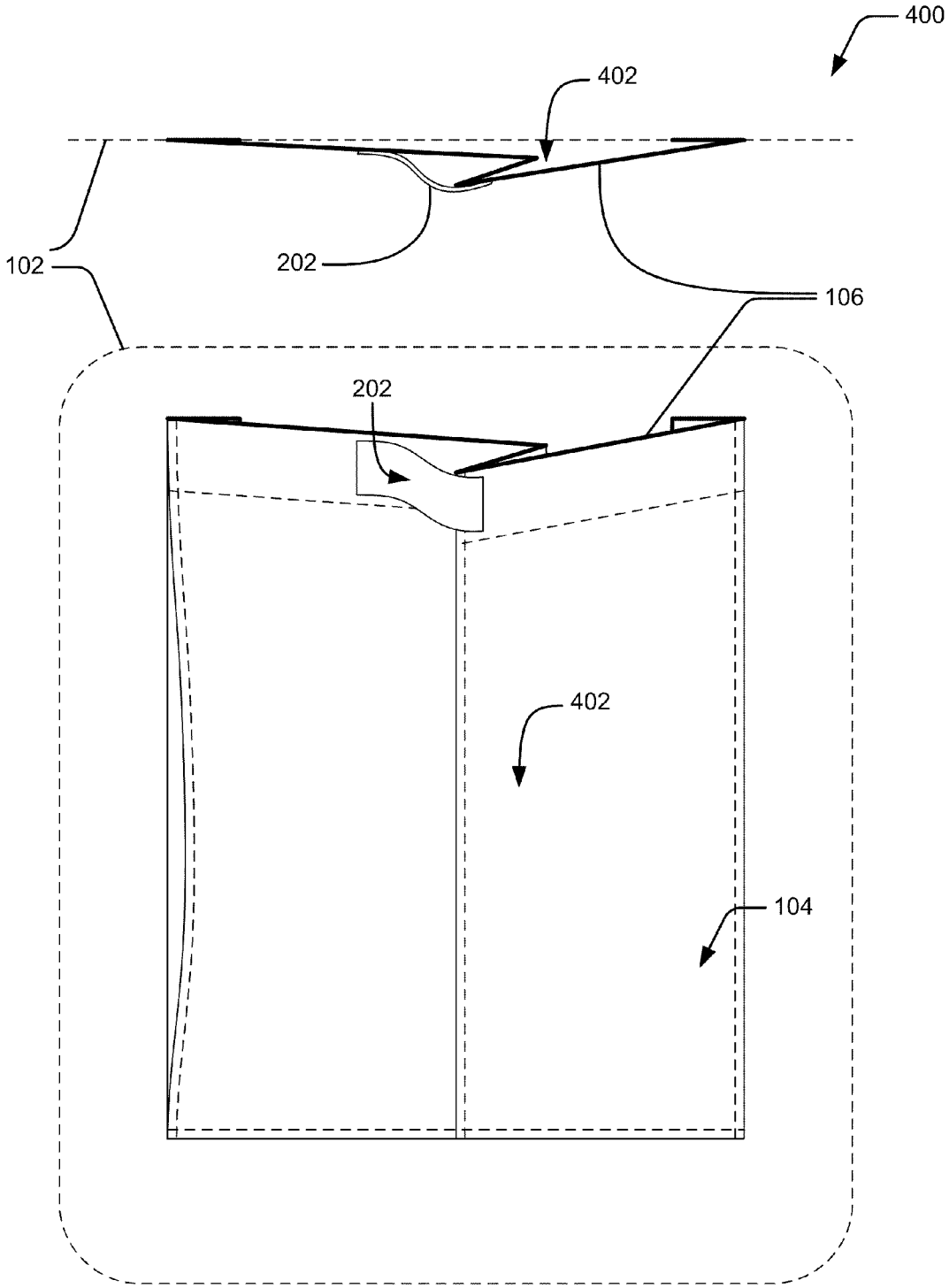
FIG. 4 is an illustration of a pocket in an example implementation depicting a pocket construction utilizing a single bellow.

FIG. 4 is an illustration of a pocket 400 in an example implementation depicting a pocket construction utilizing a single bellow 402. The illustrated pocket includes the front panel 104 and the back panel 102, as in FIG. 1. In this instance, however, the front panel 104 is creased and attached to the back panel to form a single bellow 402.

The single bellow 402 is depicted as having a slight overlap of a portion of the front panel 104. The band 202 (e.g., elastic material) is positioned at the opening 106 of the front panel 104 to bias the front panel 104 to a closed position yet maintain alignment of the stripe 108. Although a band 202 and bellow 402 has been described, a variety of different techniques may be employed to close the opening 106 of the front panel 104 yet maintain alignment, such as hook-and-loop closures, buttons and so on. As before, the pocket 400 may expand to accommodate various items and may be configured to substantially maintain the perpendicular positioning 110 and alignment of the stripe 108, as in FIG. 1. Although single and multiple bellow embodiments have been described, it should be readily apparent that a wide variety of techniques may be employed without departing from the spirit and scope thereof.

Example Garment

Figure 5:
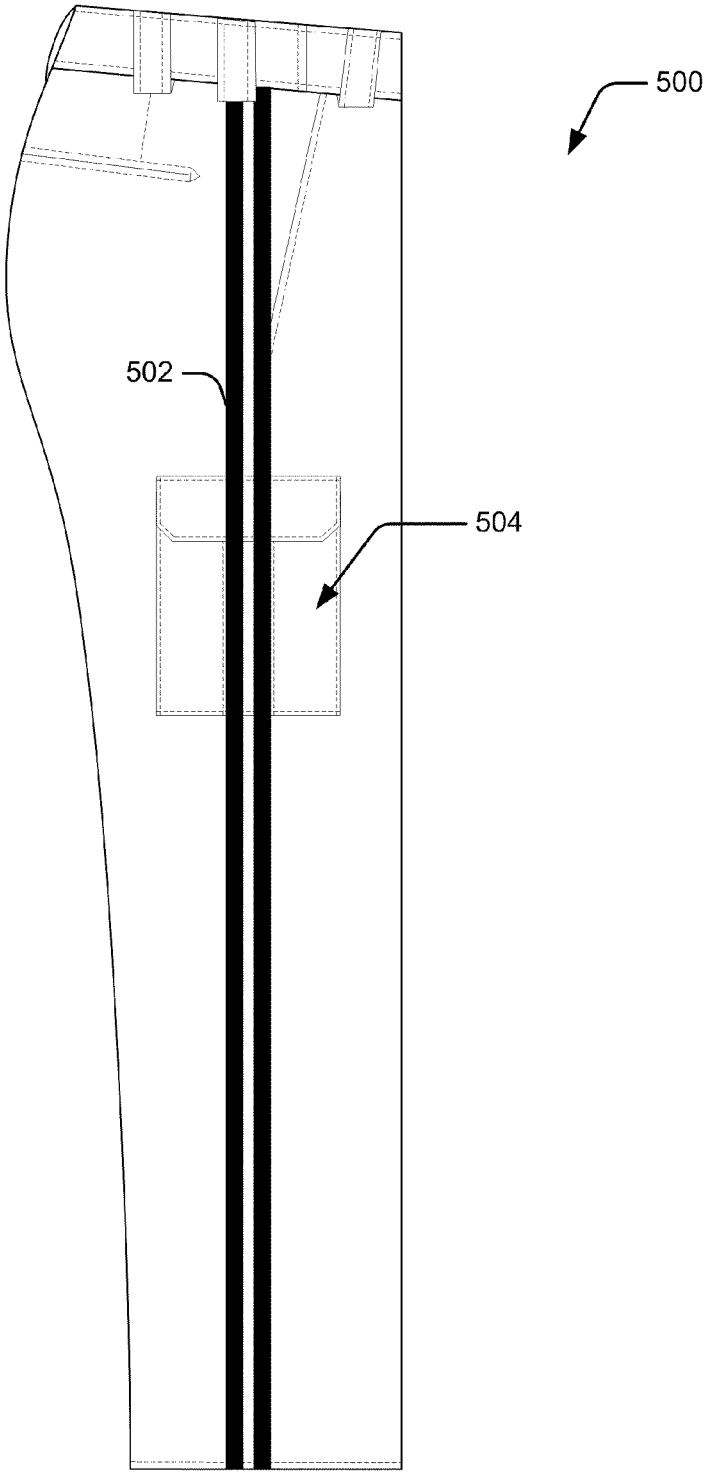
FIG. 5 is an illustration of uniform pants in an example implementation depicting a vertically-positioned stripe and a pocket, which may be configured in accordance with one or more of the previously described pockets of FIGS. 1-4.

FIG. 5 is an illustration of uniform pants 500 in an example implementation depicting a vertically-positioned stripe 502 and a pocket 504, which may be configured in accordance with one or more of the previously described pockets of FIGS. 1-4. The vertically-positioned stripe 502 is shown "running down" an outer seam of the uniform pants 500 and over the pocket 504. A variety of other locations for a pocket are also contemplated, including on a shirt, on a vest, on a backpack, and so on.

The pocket 504 is configured to expand as previously described to accommodate various items and is configured to maintain the visual continuity of the vertically-positioned stripe 502 along its length. Visual continuity includes maintaining a contiguous alignment of the vertically-positioned stripe 502 along the back panel 102 (e.g., the portion of the uniform pants 500 where the pocket 504 is located), the front panel 104, and the pocket flap. Additionally, the pocket 504 is configured to maintain the perpendicular position 110 of the vertically-positioned stripe 502 relative to the opening 106 of the pocket 500. Therefore, the pocket 504 may be suitable for inclusion as a part of a uniform or other article.

Implementation Example

The following discussion describes stripe application techniques that may be implemented in creating the previously described pockets and garments. The procedures are shown as a set of figures that specify operations performed by one or more devices and are not necessarily limited to the orders shown for performing the operations by the respective figures. In portions of the following discussion, reference will be made to the pockets 100, 300 of FIGS. 1 and 3, and the uniform pants 500 of FIG. 5.

Figure 6:
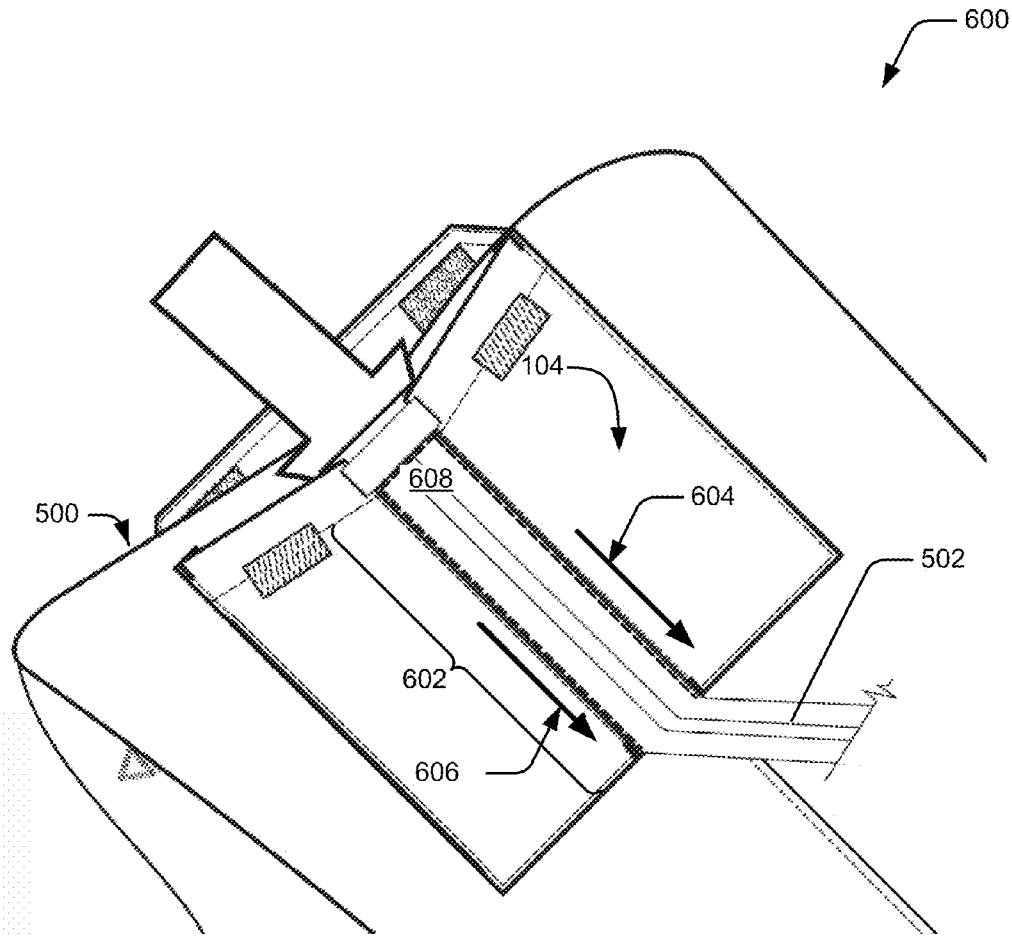
FIGS. 6-9 illustrate an example procedure of attaching a stripe.

FIG. 6 depicts a procedure 600 in an example implementation in which a stripe is applied to a front panel of an exemplary pocket, which may be configured in accordance with one or more of the previously described pockets of FIGS. 1-4. For example, vertically-positioned stripe 502 may be applied to the uniform pants 500 and over the pocket 504. As illustrated in FIG. 6, a front panel portion 602 of the vertically-positioned stripe 502 can be applied to an outer surface of the front panel 104 by attaching a first side 604 and a second side 606 of the vertically-positioned stripe 502 from an inner surface of the front panel 104.

The procedure 600 can include forming a clean top side 608 of the front panel portion 602 of the vertically-positioned stripe 502. The clean top side 608 can be formed by turning back a cut end of the vertically-positioned stripe 502 and attaching the clean top side 608 to the front panel 104. In the illustrated example, the clean top side 608 is attached to the front panel so that the clean top side 608 maintains a positioning that is substantially perpendicular to the opening 106 of the front panel 104. In this example, the first side 604 and the second side 606 of the front panel portion 602 of the vertically-positioned stripe 502 are applied to the front panel 104 beginning at the clean top side 608 and ending at a bottom of the front panel 104.

Figure 7:
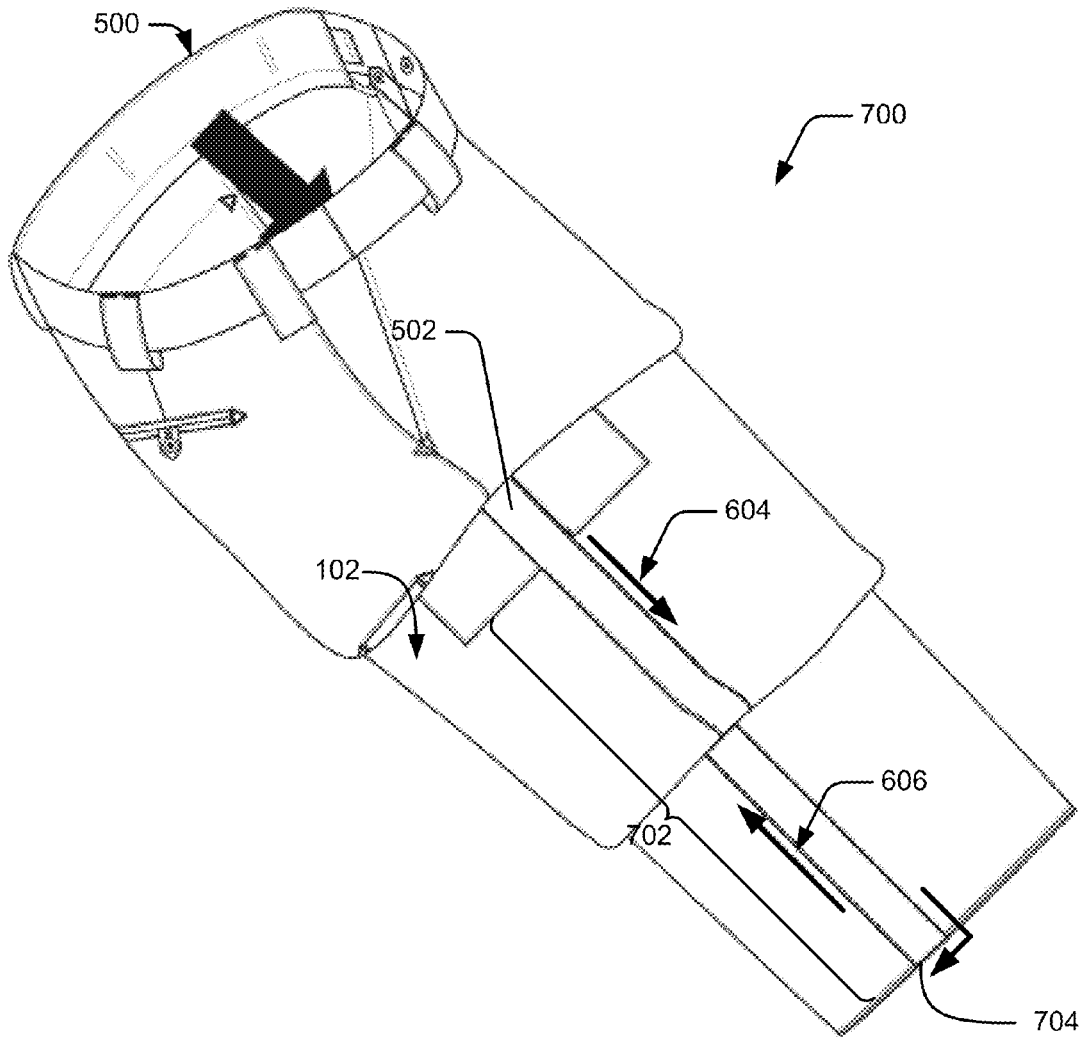

FIG. 7 depicts a procedure 700 in an example implementation in which the stripe is applied to a back panel of an exemplary pocket. Using the example described above, vertically-positioned stripe 502 may be applied to the uniform pants 500 and over the pocket 504. As illustrated, a back panel portion 702 of the vertically-positioned stripe 502 can be applied to an outer surface of the back panel 102 by attaching the first side 604 from an inner surface of the back panel 102, attaching a bottom side 704 of the back panel portion 702, and attaching the second side 606 from an inner surface of the back panel 102.

Figure 8:
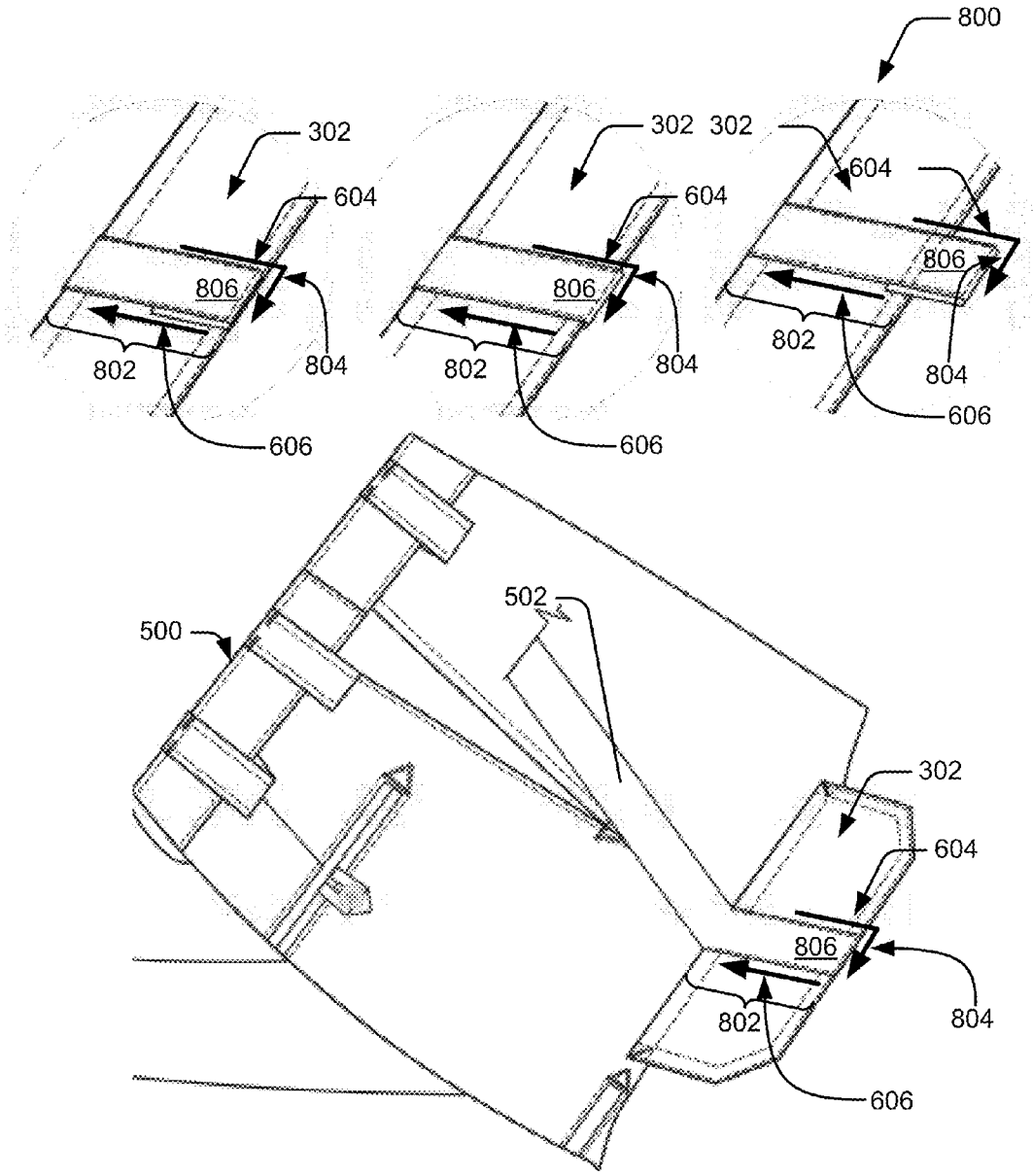

FIG. 8 depicts a procedure 800 in an example implementation in which the stripe is applied to a pocket flap of an exemplary pocket. For example, vertically-positioned stripe 502 may be applied to the uniform pants 500 and over pocket 504, which may be configured to include pocket flap 302 as in FIG. 3. Further, the vertically positioned stripe 502 may be applied so that the positioning of the vertically-positioned stripe is substantially perpendicular to the opening 106 of the front panel. In this example, the vertically-positioned stripe 502 may also be applied so that the alignment of the stripe appears contiguous along a length of the vertically-positioned stripe 502 that extends from the front panel 104 and across the back panel 102 and the pocket flap 302. As illustrated, a pocket flap portion 802 of the vertically-positioned stripe 502 can be applied by attaching the first side 604 from an under surface of the pocket flap 302, attaching a bottom side 804 of the pocket flap portion 802, and attaching the second side 606 from the under surface of the pocket flap 302.

The procedure 800 can include forming a clean bottom side 806 of the pocket flap portion 802 of the vertically-positioned stripe 502. The clean bottom side 806 can be formed by turning back a cut end of the vertically-positioned stripe 502 and attaching the clean bottom side 806 to the pocket flap 302. As illustrated in FIG. 8, the clean bottom side 806 may be attached to the pocket flap 302 in a variety of configurations.

Figure 9:
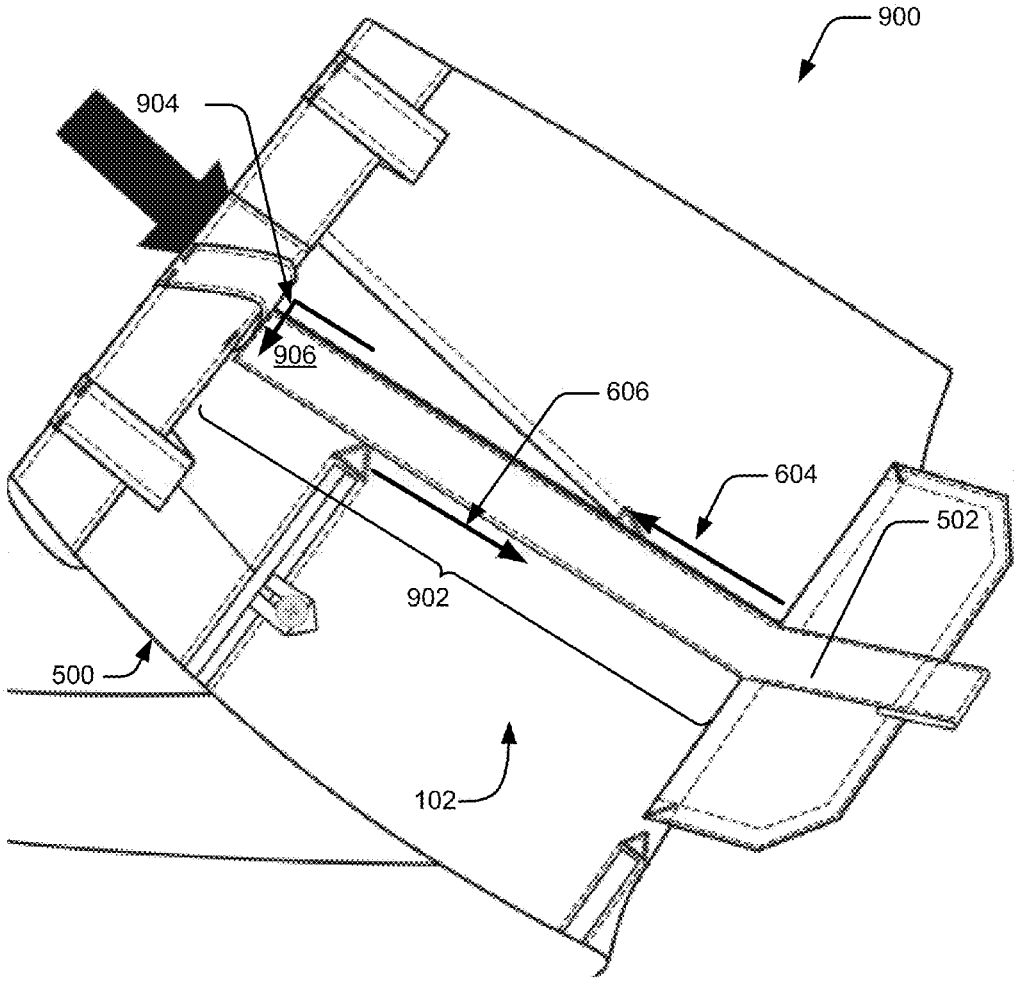

FIG. 9 depicts a procedure 900 in an example implementation in which the stripe is applied to a second portion of the back panel of an exemplary pocket. For example, vertically-positioned stripe 502 may be applied to the uniform pants 500 along an outer seam of the uniform pants 500 from just above the pocket 504 to a waist portion of the uniform pants 500. As illustrated, a second back panel portion 902 of the vertically-positioned stripe 502 can be applied to the outer surface of the back panel 102 by attaching the first side 604 from an inner surface of the back panel 102, attaching a top side 904 of the second back panel portion 902, and attaching the second side 606 from the inner surface of the back panel. The procedure

900 can include forming a clean top side 906 of the second back panel portion 902 of the vertically-positioned stripe 502. The clean top side 906 can be formed by turning back a cut end of the vertically-positioned stripe 502 and attaching the clean top side 906 to the back panel 102. Therefore, in this way vertically-positioned stripe 502 can be applied to uniform pants 500.

Conclusion

Although the invention has been described in language specific to structural features and/or methodological acts, it is to be understood that the invention defined in the appended claims is not necessarily limited to the specific features or acts described. Rather, the specific features and acts are disclosed as example forms of implementing the claimed invention.

What is claimed is:

1. A pocket comprising:

a back panel of the pocket configured as at least a portion of a pair of pants; and a front panel of the pocket attached to the back panel to form the pocket on an external surface of the pants, the front panel:

having one or more creases that form one or more bellows; and configured to expand and to maintain a positioning and a vertical alignment of a stripe stitched onto external surfaces of both the back panel and the front panel so that the vertical alignment of the stripe appears contiguous along a length of the stripe that extends over an outside of a leg of the pants from the front panel and across the back panel on the external surface of the pants in a direction that is perpendicular to an opening of the front panel, the stripe being one or more stripe pieces that are separate from the back panel and stitched along the length to the external surfaces of both the back panel and the front panel, the opening of the front panel comprising an expandable band that is configured to expand and substantially close the opening of the front panel against the back panel, the expandable band being biased to close the opening of the front panel against the back panel.

2. The pocket of claim 1, wherein:

the front panel is attached to the back panel along joined edges of the front panel and forms the opening between the front and back panels; and the front panel is configured to expand along an axis parallel to the opening.

3. The pocket of claim 1, wherein:

the opening of the front panel is configured to substantially close against the back panel when the front panel is not expanded; and the one or more bellows of the front panel are configured to lie substantially flat against the back panel when the front panel is not expanded.

4. The pocket of claim 1, wherein:

the opening of the front panel is configured to expand when the front panel is expanded; and the one or more bellows of the front panel are configured to expand when the front panel is expanded.

5. The pocket of claim 1, wherein:

the opening of the front panel is configured to substantially close against the back panel when the front panel is expanded; and the one or more bellows of the front panel are configured to expand when the front panel is expanded.

6. The pocket of claim 1, wherein the one or more creases form two bellows of the front panel and a center section of the front panel such that:

the center section of the front panel is disposed between the two bellows of the front panel;

the two bellows enable the front panel to expand; and the center section of the front panel has a substantially perpendicular alignment to the opening of the front panel.

7. The pocket of claim 6, wherein the stripe is located on the center section of the front panel.

8. The pocket of claim 7, wherein:

the two bellows of the front panel are configured to lie substantially flat against the back panel when the front panel is not expanded; and the center section of the front panel is configured to maintain the vertical alignment that is perpendicular to the opening of the front panel when the front panel is not expanded.

9. The pocket of claim 7, wherein:

the two bellows of the front panel are configured to expand when the front panel is expanded; and the center section of the front panel is configured to maintain the vertical alignment that is perpendicular to the opening of the front panel when the front panel is expanded.

* * * * *